United States Patent [19]

Sharma

[11] 4,152,911

[45] May 8, 1979

[54] SAFETY DEVICE FOR A KNOB CONTROLLED DOOR LOCK

[76] Inventor: Prannath Sharma, 4 Park Ave., New York, N.Y. 10016

[21] Appl. No.: 848,470

[22] Filed: Nov. 4, 1977

[51] Int. Cl.[2] ..... E05B 15/00; E05B 17/00

[52] U.S. Cl. ..... 70/416; 70/431

[58] Field of Search ..... 70/416, 429, 430, 431; 292/153; 248/300; 211/90, 153

[56] References Cited

U.S. PATENT DOCUMENTS

| | | | |
|---|---|---|---|
| 979,331 | 12/1910 | Odenz | 70/429 |
| 1,055,510 | 3/1913 | Birkle | 70/429 |
| 1,270,718 | 6/1918 | Ford | 248/300 |
| 1,317,307 | 9/1919 | Mittleburg | 211/90 |
| 1,700,135 | 1/1929 | Lanes | 70/416 |
| 3,423,974 | 1/1969 | Bernslex | 70/416 |
| 3,669,480 | 6/1972 | Fugate | 248/300 |
| 3,921,423 | 11/1975 | Hollins | 70/416 |

*Primary Examiner*—Robert L. Wolfe

*Attorney, Agent, or Firm*—Posnack, Roberts, Cohen & Spiecens

[57] ABSTRACT

A door handle lock assembly is provided for a door having opposite sides, the door being pivotally mounted in a frame and adapted to close the opening in the frame. A safety device is mounted on the door on the same side thereof as is a knob which controls a lock bolt which is adapted to be inserted into the frame to lock the door thereto. The safety device includes an elongated member which is pivotal on the door into positions of interference and non-interference with movement of the knob. The safety device is provided with two perpendicularly related flanges with a further flange which is adapted to abut against the knob when the knob is in a position of rest with the locking bolt extending outwardly into the door frame.

4 Claims, 5 Drawing Figures

SAFETY DEVICE FOR A KNOB CONTROLLED DOOR LOCK

FIELD OF INVENTION

This invention relates to door locks as well as other locks similar thereto and more particularly to safety devices for locks and methods of making such safety devices.

BACKGROUND

In developing security of dwellings, places of business and the like, there is a need for a safety device which will prevent the forcing of an internally located and controlled locking mechanism from the outside of the space for which security is desired. Many locking devices, for example, include an internally located pivotal knob, the function of which is to project a locking bolt into the frame of the door or window and to retract the locking bolt therefrom. It is known to prevent access to such a knob or to lock the knob in fixed position so that unauthorized movement of the locking bolt is not possible.

A number of safety devices of the above indicated general type are known. Some of these devices are shown, for example, in U.S. Pat. Nos. 3,263,462; 3,423,974; 3,826,556; 3,921,423; and 3,933,014.

L. W. Suroff in U.S. Pat. No. 3,263,462 discloses an arrangement in which a retaining device includes a base which is adapted to engage a conventional lock with a press fit and which is provided with inside faces which telescope over a lock actuator to thereby prevent a knob from being rotated by any appreciable amount when a key is inserted from the outside of the associated door.

C. U. Bernsley in U.S. Pat. No. 3,423,974 provides an auxiliary door lock or safety in which a plate is mounted pivotally on a door and is provided with an opening which is adapted for selectively encircling a knob in such a manner as to prevent unauthorized operation of the knob from the outside of the associated door.

In U.S. Pat. No. 3,862,556, A. Moses shows a clamping attachment for a lock-bolt thumb knob for preventing the lock from being opened from the outside. This clamping attachment consists of a U-shaped wire bracket which can be snapped onto the door knob hub. which acts as an anchor for the attachment. The closed end of the attachment forms a claw for gripping the wings of the thumb knob and preventing the lock from being opened from the outside by a pass key or other device.

J. R. Hollins shows in U.S. Pat. No. 3,921,423 a door lock assembly including a dead bolt and a knob on the inside of a door for controlling the extension and retraction of the dead bolt. The safety device herein provided is secured to the inside surface of the door and operates selectively to prevent the dead bolt control knob from rotating to retract the dead bolt from an extended position whereby the door is locked. The safety device includes a block from which extends a bar which moves into a position of interference with the aforesaid knob.

A. Moses provides in U.S. Pat. No. 3,933,014 a snap-on clamping attachment for a lock-bolt thumb knob for preventing the lock from being opened from the outside. One of the attachments has elements that can embrace the thumb knob and the connected elements have two extended legs that grip the door knob hub and can bias the attachment to its operative position or hold it inoperative position.

SUMMARY OF INVENTION

It is an object of the invention to provide an improved safety device for knob controlled door locks and the like and to provide as well improved door and lock assemblies provided with safety devices intended to prevent unauthorized operation of a lock and unauthorized access to a space, the security of which is to be improved.

It is another object of the invention to provide an improved safety device, the simplicity of which permits great ease in manufacture as well as ease in installation and use.

Still another object of the invention is to provide an improved safety device whose construction admits of durability and longevity and which requires no maintenance and repair.

Still another object of the invention is to provide an improved safety device having great ease and speed of operation.

Yet another object of the invention is to provide an improved safety device which is economical in use and installation as well as in manufacture and initial cost.

Many of the security devices previously available require a plurality of holes for installation, a skilled artisan for installation and accurate measuring of various distances and other installation parameters as well as laborious positioning and upkeep. The safety device of the invention may be installed by anyone capable of drilling a single hole and inserting and tightening a single screw.

The economic quality of the invention derives from the fact that it is a small device utilizing few parts and requiring no replacement parts and that it is a device which is readily installed for securing door and window locks for the fraction of the cost of a locksmith. The device of the invention is susceptible of installation by the purchaser with no skilled labor being required. For apartment dwellers that are charged per hole upon vacating their apartments, such apartment dweller is required only to use a single screw and thus involve himself with no more than a single hole.

To achieve the above and other objects and advantages of invention, there is provided a door hand lock assembly comprising a door having opposite sides, a frame defining an opening adapted to be closed by said door, a bolt in said door to be displaced into said frame to lock said door thereto, a pivotable control knob on said door on one side of the same and coupled to said bolt to control displacement of the same, said knob being pivotable between limits at first and second positions, said bolt being displaced into said frame in correspondence with the first position of said knob and that of said frame in correspondence with said second position, and means pivotable into and out of a position of interference with respect to the pivoting of said knob and adapted, when in a position of interference, to brace said knob in said first position to lock said bolt in said frame.

Said means may include a pivot, defining a pivot axis, said knob including a portion for engagement with said means, said portion defining a path of movement which is a circular arc upon pivoting of said knob, a tangent to said arc at said knob with the knob in said first position passing within, for example, 20° of said pivot axis.

The aforesaid means will include as part thereof a rigid rectilinear structure pivotable on said axis to a position between said axis and said portion of the knob and adapted to be approximately parallel with said tangent.

Said structure may have a length substantially corresponding to the distance between said axis and said portion with said knob in said first position.

Moreover, said means may be on the same side as the knob and will be spaced in entirety from the other side of the door to prevent any unauthorized access with respect thereto.

Said rigid structure may be at least part of a bar, said means including a flange on said bar defining one limit of said part and adapted to be positioned at right angles to said tangent and moved into engagement with said knob with the latter in said first position.

Moreover, said bar may have a longitudinal axis and said flange may be arranged to be perpendicular thereto.

According to a further feature there may be provided a second flange on and perpendicular to said bar, said second flange also being perpendicular to the first said flange, said second flange having a path of movement which is an arc passing through said knob in the first position thereof and being adapted to abut said knob with the knob in said first position approximately along a tangent to the latter said arc.

The pivot noted hereinabove may be a screw passing through said bar and partly through said door but spaced from the outside of the latter. The bar may be provided with an opening through which said screw passes.

According to still a further feature of the invention, said means may be provided with a further opening and a further flange in mirror relationship with the first said opening and the first said flange.

Preferably, the knob will be positioned generally below said screws so that the weight of said means tends to pivot the same into engagement with said knob.

According to another aspect of the invention, there is provided a safety mechanism comprising an elongated beam which is L-shaped in cross-section and includes first and second flanges, said first flange being longer than said second flange and extending beyond the same at at least one end thereof and a third flange on said second flange at right angles to said first and second flanges.

Said second flange may be provided adjacent the other end thereof with an opening having an axis parallel to said third flange. A fourth flange may be provided on said second flange and said second flange may be provided with a second opening, said second opening and said fourth flange being in mirror image relation with the first said opening and third flange.

According to still another aspect of the invention, there is provided a method of making a safety device comprising forming an elongated sheet having two ends and a longitudinal axis, forming a slit in the sheet parallel to said axis and approximately centrally of said sheet at one end thereof, folding the sheet along a line which is an extension of the resulting slit to form two flanges at right angles to each other, and then a further flange from one of the first two said flanges and perpendicular to the same. Moreover, the method may comprise forming a hole in said one flange spaced substantially from said further flange.

Other objects, features and advantages of the invention will be found in the detailed description which follows hereinafter.

DETAILED DESCRIPTION

Figure 2:
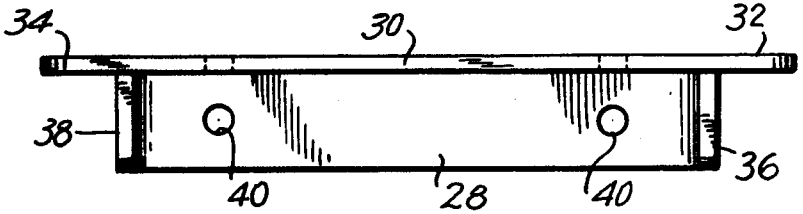
FIG. 2 is a side view of the safety device of the invention as shown in FIG. 1.
Figure 3:
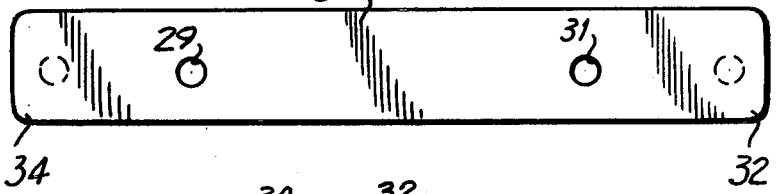
FIG. 3 is a top view of the safety device illustrated in FIG. 2.
Figure 4:
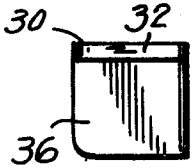
FIG. 4 is an end view of the safety device of FIGS. 2 and 3.

As has been indicated hereinabove, there is provided in accordance with the invention a door and lock assembly provided with a safety device. The assembly comprises a door having opposite sides and pivotally installed in a frame having an opening adapted to be closed by the door. A bolt is provided in the door to be selectively displaced into and out of the frame for selective locking of the door to the frame. A pivotal or pivotable control knob is provided on the door on one side of the same and internally located in the space, the security of which is to be improved. The knob is coupled to the bolt to control displacement of the same. This knob is pivotable between limits at first and second positions, said bolt being displaced into said frame in correspondence with the first position of the knob and out of the frame in correspondence with the second position of the knob.

In accordance with the invention, a device is provided which is pivotable into and out of a position of interference with respect to the pivoting of the knob and the device is adapted, when in a position of interference, to brace said knob in the first position to lock of the bolt and the frame.

Referring next to FIGS. 1–4, there is shown a door 10 located in a frame 12 conventionally having a reinforcement plate 14 through which may extend a locking bolt 16 mounted internally of the door and adapted for selective extension into the frame 12 for selective locking of the door to the frame. The frame conventionally defines an opening which is to be closed by the door.

The door is conventionally provided with a knob 18 which permits manipulation of the door which is furthermore provided with a knob 20 which is conventionally coupled by means (not shown) to the bolt 16 to permit operation of the same. In the position of the knob illustrated in solid lines, which may be considered to be the first position of this knob, the bolt 16 is in extended position extending into the frame 12 to secure the door 10 thereto. In the position of the knob 20, illustrated in dotted lines (which may be regarded as the second limit position of the knob) the bolt 16 is withdrawn from the frame 12 thereby permitting free movement of the door 10 under control of the knob 18 or its equivalent on the opposite or outer side of the door.

The illustrated positions of the knob 20, which controls the bolt 16, are limit positions; that is, the mechanism associated with the knob does not permit of moving the knob beyond the range established or defined by the first and second illustrated positions. Accordingly, it is possible to lock the knob 20 in the position illustrated in solid lines by moving a safety device into a position of interference therewith to hold the knob firmly in this position whereby the bolt, following suit, will be maintained in its extended position as illustrated. This, of course, must be achieved while minimizing possible access to the safety device so that it cannot be operated from outside of the door and the space for which security is to be improved.

To achieve the ends described hereinabove, there is provided in accordance with the invention, a safety device generally indicated at 26. This safety device includes first and second flanges 28 and 30, the flange 30 being perpendicular to flange 28 and extending beyond the same in the form of cantilever portions 32 and 34. The flange 28 furthermore supports two further flanges 36 and 38, these flanges being perpendicular to both of the first said flanges 28 and 30.

In addition to the aforesaid arrangement of flanges, there are provided a pair of openings one of which is indicated at 40 and the other of which accommodates a screw 42 constituting the pivot axis for the device. The pivot axis is parallel to flanges 36 and 38. Washers (see, e.g., W) may be provided on screw 42 on opposite sides of flange 28.

It will be noted that the opening 40 and flange 36 are in mirror image relationship with the hole accommodating screw 42 and flange 38. Actually, only one of these two possible combinations is employed at any given time with the alternative being provided to accommodate different mountings of the device on a door depending upon the arrangement and operation of the knob 20.

Figure 1:
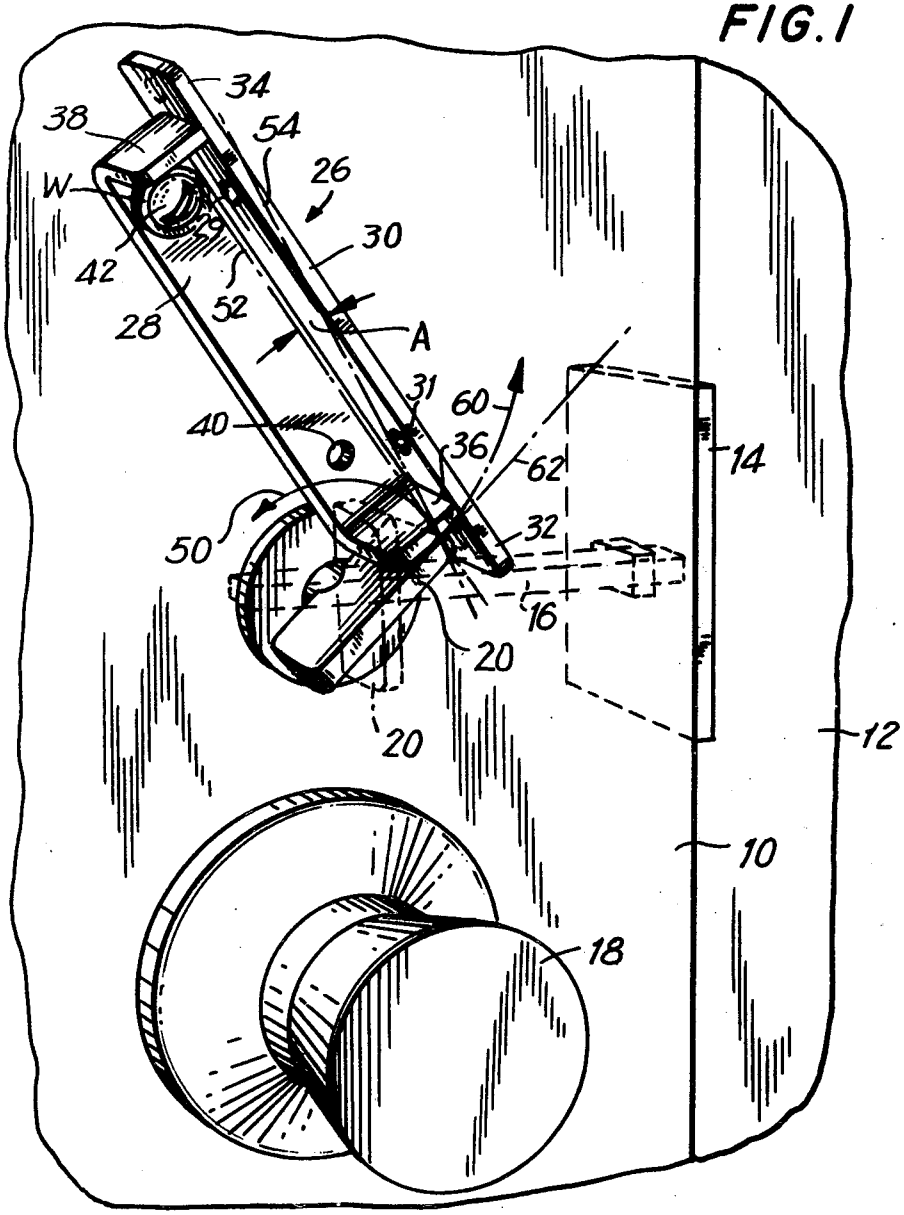
FIG. 1 is a perspective partially diagrammatical and hidden view of a door and lock assembly provided with a safety device in accordance with the invention.

As has been generally noted hereinabove, the knob includes a portion for engagement with the safety device of the invention. This portion defines a path of movement which is a circular arc upon pivoting of the knob. A tangent to this arc at the knob, with the knob in the position indicated in solid lines, passes within 20° of the pivot axis and preferably passes through the pivot axis. In FIG. 1 the circular arc path of movement is indicated at 50. The tangent referred to above is indicated at 52. A range of deviation is indicated by line 54 and the angle of deviation mentioned above is indicated at A. This angle, as noted, is preferably 20° in maximun extent and preferably less. In its preferred form, the tangent 52 will pass through the pivot axis defined by the screw 42.

As has been indicated hereinabove, the safety device includes a rigid rectilinear structure pivotable, for example, on the axis provided by screw 42 to a position between this axis and the portion of the knob 20 in engagement, for example, with the flange 36. This rectilinear structure is the rigid structure between the screw and flange 36 with the safety device being constituted preferably of a metal such as aluminum or steel (but also possibly of plastic or the like). It will be appreciated that a rigid rectilinear structure is provided. However, it must be clear that within the scope of the invention, this structure does not have to appear visually as rectilinear as long as there is effectively provided a structure which can constitute a brace as between the flange 36 and screw 42.

It will also be appreciated that, as stated above, this rigid structure has a length substantially corresponding to the distance between the axis of screw 42 and the knob so as to constitute a brace with the flange 36 jammed against the knob 20 and frictionally moving into engagement with the same. Actually, frictional engagement is not essential since the flange 36 and the part 32 define a receptacle therebetween for receiving knob 30 and holding the safety device in the illustrated position of interference.

It will be readily appreciated that the safety device is on the same side of the door as the knob 20. It will also be understood that screw 42 passes through the flange 28 and only partially through the door 10 so as to be completely unaccessible to persons located outside of the door. The safety device and screw are therefore spaced in entirety from the outer side of the door. It will also be understood from what has been stated that the tangent 52 coincides with what might be considered the longitudinal axis of the safety device with the flanges 36 and 38 as being perpendicularly related thereto.

As has also been stated hereinabove, the flange 36 which is perpendicular to flanges 28 and 30 has a path of movement which is an arc passing adjacent the knob in the first position thereof, as illustrated in solid lines. This flange is adapted to abut the knob, with the knob in this first position, approximately along a tangent to the latter said arc. The latter said arc is illustrated in FIG. 1 at 60 and the tangent referred to is illustrated at 62. The precise positioning of the screw 42 will lead to the foregoing results and will provide an optimum arrangement as between knob 20 and safety device 26. However, it is to be understood that this perfect arrangement is not required in accordance with the limits of the invention since the arrangement of portion 32 and flange 36 will admit of variations in installation so that a great accuracy is not required.

In the illustrated arrangement, the knob 20 is positioned generally below the screw so that the weight of the safety device tends to pivot the same into rather than out of engagement with the knob. However, the resulting movement of the safety device 26 will not interfere with operation of the knob 20 since the user may readily displace the device 26 to a position of non-interference with knob 20 when in the process of operating the latter by hand.

Viewing the structure of the safety device of the invention from another aspect thereof, it is seen that the safety mechanism is constituted by an elongated beam which is L-shaped and cross-section and includes first and second flanges whereof the first flange is longer than the second flange and extends beyond the same at at least one end thereof. A third flange can be provided on the second flange at a right angle to the first and second flanges and a fourth flange may furthermore be provided, there being also formed in the safety device two openings with which the latter said flanges cooperate, these parts and openings being in mirror relationship with one another.

Figure 5:
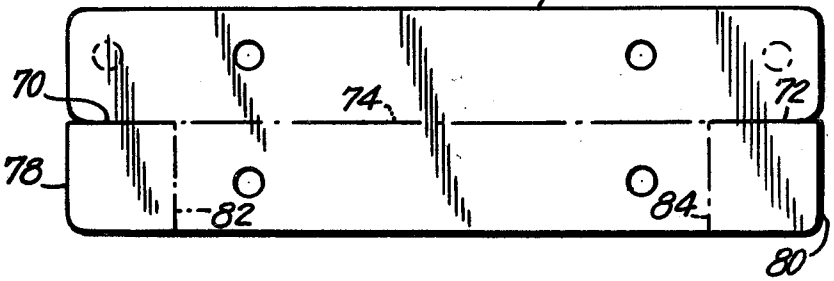
FIG. 5 illustrates a sheet prior to formation into the safety device of FIGS. 1–4.

According to the method of the invention, an elongated sheet such as illustrated in FIG. 5 may be provided with slits 70 and 72 formed along the longitudinal axis 74 of the sheet which is indicated at 76. The sheet may be formed of steel, aluminum or the like. The axis 74 is indicated as being located centrally of the sheet with the slits 70 and 72 being at opposite ends 78 and 80 of the sheet.

The bending of the sheet along a line coinciding with the longitudinal axis and connecting the slits will form two flanges at right angles to each other. Additional flanges may then be formed along lines 82 and 84 by bending the sheet along these respective lines thereby to form the structure in FIGS. 1–4.

From the above it will be appreciated that the safety device of the invention is readily manufactured at low cost as well as readily installed and utilized for purposes of improving the security of the space actuated by a door provided with a lock, the use of which is enhanced by the safety device of the invention.

The device of the invention may also be used as a sliding door handle or on windows, desks or cabinets or the like. For this purpose the device may be provided with extra holes (e.g. holes 29 and 31 or the like).

The device may also be used as a lifting handle on one or both sides of wooden or metal boxes, trunks, tables, luggage, desks or on any object which requires one or two hands for lifting.

Further, two such devices may be used as support brackets on opposite sides of curtain rods or to support horizontal wooden or metal slats or strips in order to hang plants or any object for decoration or for any other such purpose. The device may also be used as a picture hanger or on walls or on ceilings for hanging lights, lamps or similar objects. It may also be used as a connecting bracket for partitions or dividing panels in a room.

There will now be obvious to those skilled in the art many modifications and variations of the structure and method set forth hereinabove. These modifications and variations will not depart from the scope of the invention if defined by the following claims.

What is claimed is:

1. A door and lock assembly comprising a door having opposite sides, a frame defining an opening adapted to be closed by said door, and a bolt in said door to be displaced into said frame to lock said door thereto, a pivotable control knob on said door on one side of the same and coupled to said bolt to control displacement of the same, said knob being pivotable between limits at first and second positions, said bolt being displaced into said frame in correspondence with the first position of the knob and out of said frame in correspondence with said second position, and means pivotable into and out of a position of interference with respect to the pivoting of said knob and adapted, when in a position of interference, to brace said knob in said first position to lock said bolt in said frame, said means including a pivot defining a pivot axis, said knob including a portion for engagement with said means, said portion defining a path of movement which is a circular arc upon pivoting of said knob, a tangent to said arc, at said portion with the knob in said first position, passing within twenty degrees of said pivot axis, said means including a rigid structure pivotable on said axis to a position between said axis and said portion, said structure having a length substantially corresponding to the distance between said axis and said portion with said knob in said first position, said means being on the same side of the door as said knob and spaced in entirety from the other side of the door, said rigid structure being at least a part of a bar, said means including a first flange on said bar defining one limit of said part and adapted to be positioned at right angles to said tangent and to engage said knob with the latter in said first position, said bar having a longitudinal axis and said first flange being perpendicular thereto, a second flange on and perpendicular to said bar, said second flange also being perpendicular to the first said flange, said first flange having a path of movement which is an arc passing adjacent said knob in the first position thereof and being adapted to abut said knob, with the knob in said first position, approximately along a tangent to the latter said arc, the knob being positioned generally below said pivot so that the weight of said means tends to pivot the same into engagement with said knob, said bar and second flange defining an L-shaped cross-section, said second flange being longer than said bar.

2. An assembly as claimed in claim 1 wherein said pivot is a screw passing through said bar and partly through said door.

3. An assembly as claimed in claim 1 wherein said bar is provided with an opening through which said screw passes.

4. An assembly as claimed in claim 3 wherein said means is provided with a further opening and a further flange in mirror relationship with the first said opening and the first said flange.

* * * * *